United States Patent [19]

Bates

[11] Patent Number: 4,683,670

[45] Date of Patent: Aug. 4, 1987

[54] DEMOUNTABLE SIGNBOARDS

[75] Inventor: Donald L. Bates, Orange, Calif.

[73] Assignee: Eldon Industries, Inc., Inglewood, Calif.

[21] Appl. No.: 791,454

[22] Filed: Oct. 25, 1985

[51] Int. Cl.[4] ..... G09F 7/00

[52] U.S. Cl. ..... 40/620; 411/373

[58] Field of Search ..... 24/590; 40/620; 411/373, 429, 371, 372; 16/DIG. 4; 248/466, 477

[56] References Cited

U.S. PATENT DOCUMENTS

| | | | |
|---|---|---|---|
| 843,235 | 2/1907 | Richardson | 40/611 |
| 884,570 | 4/1908 | Claridge | 40/611 |
| 1,413,082 | 4/1922 | Weinrich | 24/590 |
| 1,691,638 | 11/1928 | Carney | 40/620 |
| 4,044,813 | 8/1977 | Emmons | 248/466 |
| 4,406,033 | 9/1983 | Chisholm et al. | 411/373 |
| 4,413,374 | 11/1983 | Ferdinand et al. | 411/373 |

FOREIGN PATENT DOCUMENTS

| | | | |
|---|---|---|---|
| 1058460 | 3/1954 | France | 411/373 |
| 8502447 | 6/1985 | PCT Int'l Appl. | 411/373 |
| 24860 | of 1914 | United Kingdom | 411/429 |
| 374925 | 6/1932 | United Kingdom | 40/620 |
| 914137 | 12/1962 | United Kingdom | 40/620 |
| 1100591 | 1/1968 | United Kingdom | 40/620 |

*Primary Examiner*—Gene Mancene
*Assistant Examiner*—Cary E. Stone
*Attorney, Agent, or Firm*—Edward D. O'Brian

[57] ABSTRACT

A signboard of a type used to carry replaceable letters or similar indicia can be improved by using at least one easily operated holder to connect the signboard to a support such as a wall. This permits the signboard to be easily removed from the support so that it can be held in a convenient manner as the content of a sign on the signboard is changed or altered.

11 Claims, 6 Drawing Figures

DEMOUNTABLE SIGNBOARDS

BACKGROUND OF THE INVENTION

The invention set forth in this specification pertains to new and improved demountable signboards. It is primarily concerned with signboards which are constructed so that they can be easily taken off of a supporting surface or structure so as to facilitate replacement of the letters or the like on these boards.

Signboards constructed so as to be used with replacable letters or other symbols are normally built so as to include a base or a board having a surface provided with grooves or similar members shaped so as to be capable of holding individual letters, symbols, lines of letters or other indicia so that such indicia are visible through a transparent cover or door mounted on the base or board. Occasionally such signboards are provided with a surface which is adapted to be used with pins, thumb tacks or similar fastners instead of a surface having such grooves or similar members. It is also known to manufacture such structures using surfaces which will attract or hold a magnet or which will frictionally support specialized types of letters or symbols.

It is common to vertically mount such signboards on an appropriate supporting surface such as a wall, a support pillar or post or the like so that the cover or door can either be removed from them or can be swung to an out of the way position so as to allow the letters and/or symbols on them to be replaced. Frequently it is rather difficult to change or modify the letters or symbols on such signs because of the fact that they are vertically mounted. Individuals who use bifocal lenses in their glasses usually find it particularly difficult to adjust or change the indicia used with such signboards. This is particularly the case when such signboards are comparatively tall structures such as are commonly used for building directories in large buildings or other similar structures.

BRIEF SUMMARY OF THE INVENTION

As a result of the recognition of such servicing difficulty it has been realized that there is a need for new signboards of the type indicated in the preceding discussion which can be more easily serviced so as to change or modify the letters or other symbols or indica on such boards than known signboards. The invention is intended to meet this need. It is intended to provide new and improved signboards for this purpose which may be easily and conveniently constructed at a comparatively nominal cost, which may be easily installed with little or no significant difficulty, which may be easily demounted for servicing purposes and which then may be easily remounted. As a result of the fact that these signboards may be easily demounted and then remounted they can be positioned so that it is easy to work on them as the letters and symbols on them are changed or rearranged.

These and various related objectives of this invention are achieved by providing in a signboard including a base having a front, a back and a front surface which is adapted to hold replaceable indicia the improvement which comprises: a holding means for connecting said base with a vertical support for said base, said holding means including a retainer having a hollow tubular peripheral wall and a bottom which is adapted to be secured to said support through the use of a fastner, said base including an opening located therein which extends between the front and the back of said base and which is shaped so as to fit closely around the exterior of said peripheral wall, said holding means also including a retainer having a head which is adapted to fit against the front of said base and a shank shaped so as to fit within said peripheral wall, said shank and the interior of said peripheral wall being shaped so as to include coacting fastening means which, when engaged, secure said board against movement relative to said holding means.

BRIEF DESCRIPTION OF THE DRAWING

Because of the nature of this invention it is considered desirable to describe it in further detail by referring to the accompanying drawings forming a part of this disclosure in which.

Figure 1:
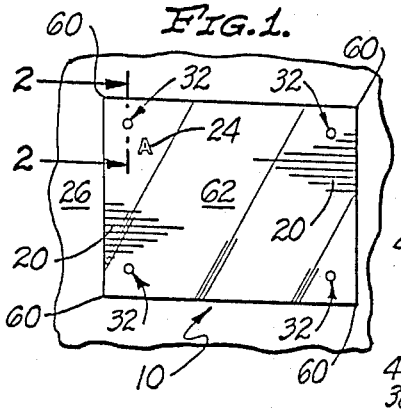
FIG. 1 is a front elevational view of a presently preferred embodiment or form of a demountable signboard in accordance with this invention.
Figure 2:
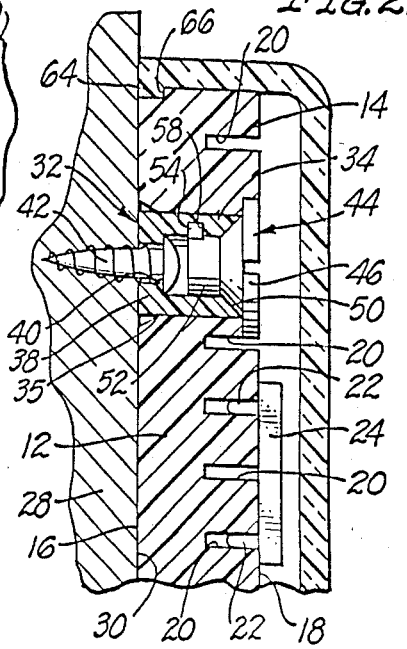
FIG. 2 is a partial cross-sectional view at an enlarged scale taken at line 2—2 of FIG. 1.
Figure 3:
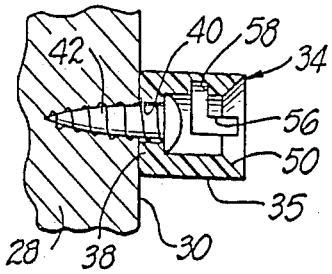
FIG. 3 is a view corresponding to FIG. 2 but showing only the mounting member shown in the preceding FIG. 2 in cross section.

The signboards illustrated in the drawing utilize the principles and concepts of this invention set forth and defined in the appended claims forming a part of this disclosure. Those familiar with the design and construction of signboards will realize that these concepts and principles can be used in connection with differently appearing and differently constructed signboards through the use of routine skill as is normally utilized in connection with the design and construction of signboards.

DETAILED DESCRIPTION

The signboard 10 illustrated in FIG. 1 of the drawings includes a base or board 12 having a front 14 and a back 16. This board 12 will normally be formed of an opaque self supporting composition so as to include a front surface 18 which is provided with grooves 20 capable of frictionally retaining rear extensions 22 on letters such as the single letter 24 shown. It is to be understood that a variety of differently shaped grooves as are known and used with prior related signboards can be substituted for the precise grooves 20. Similarly the signboard 10 can be used with different, known letters than the letter 24 having the extensions 22. Also, known other surfaces than the surface 18 which are capable of holding or retaining other types of letters than the letter 24 can be used. Various other indica than letters can be substitute for the letter 24 shown or used with letters such as this letter 24.

The board 12 is adapted to be secured to the surface 26 of an appropriate support 28 such as a common vertical wall 30 through the use of what are designated herein as "holding means" 32. Each of these holding means 32 includes a mounting member 34 which is preferably formed of a somewhat resilient yet selfsupporting material such as linear polyethylene, a moldable grade of a Nylon polymer or other similar material.

Each mounting member 34 has a hollow, tubular, cylindrical peripheral wall 35 shaped so as to fit closely with in an opening 36 in the board 10 and a bottom 38 with a centrally located aperture 40. Each of these holding means 32 is formed in this manner so that it can be easily secured to the wall 30 through the use a common fastner 42 such as the screw illustrated.

Each of the holding means 32 also includes a retainer 44 of a material such as is used in a mounting member 34 or of another more rigid material. Each retainer 44 includes an enlarged, slotted, bevelled head 46 which is adapted to overlie a beveled depression 50 in the mounting member 34 so as to hold the board 12 in place against the wall 30 without extending outwardly from the front surface 18. Preferably each head 46 will be of the same color as the front surface 18 so as not to be overly visible. Each retainer 44 also includes an extending cylindrical shank 52 which is adapted to fit closely with a peripheral wall 35. Each shank 52 carries a projection 54 which is adapted to fit within a groove 56 having a circumferentially extending end 58 located in the peripheral wall 35.

The projection 54 and the groove 56 are shaped so as to serve as the essential elements of a common bayonet connection. Hence, they may be referred to as coacting fastening means or bayonet connection means (not numbered) which, when engaged, will serve to secure the board 12 to the wall 30 by holding the associated retainer 44 so that its head 46 engages the board 12 so that it cannot be moved off of the peripheral wall 35.

In the sign 10 four of these holding means 32 are employed as shown in FIG. 1 of the drawing so that each holding means 32 is associated with and adjacent to a corner 60 of the sign 10 in order to firmly hold the entire sign 10 against the wall 30. Preferably the board 12 is capable of being bent or warped slightly so that these corners 60 can be pulled up against the wall 30 even when this wall 30 is not completely flat so that the corner 60 will not significantly stand out from the wall 30. At least three spaced holding means 32 should normally be employed since three points determine a plane. An opening 36 in the board 12 must, of course, be used with each holding means 32.

The complete sign 10 will normally include other features than are indicated in the preceding. Thus, it preferably includes a transparent cover 62 which has at least an upper peripheral lip 64 which is adapted to be hooked over an upper edge 66 on the board 12 so that it will overlie the front surface 18 or another similar related cover or door serving to protect the front surface 18 and items (not shown) such as the letter 24 located on it. The sign 10 can also be modified in other well known manners such as by the inclusion of a light or related structure. It is not considered necessary to describe or illustrate such modifications since they are not reasonably related to this invention.

The significant advantage of the invention is that after the sign 10 is installed the sign may be easily taken down or demounted so that the indicia displayed on the front surface 18 can be changed as the board 12 is held in any convenient manner for servicing. Normally the board 12 will be held horizontally as the content of the sign 10 is changed or altered. In taking the sign 10 down it is only necessary to remove the cover 62 by lifting it off the board 12 and then to disengage the retainers 44 so that the board 12 can be lifted off of the mounting members 34. The reverse of this series of operations is employed in remounting the sign 10. The use of bayonet connections expedites the mounting and demounting of this sign 10.

Figure 4:
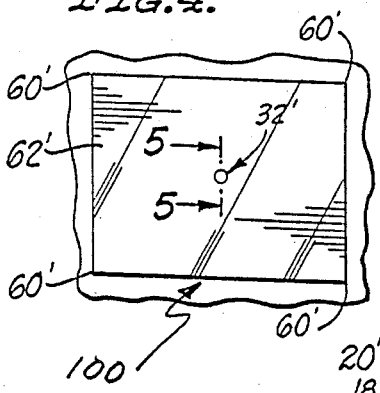
FIG. 4 is a front elevational view of a modified form of a signboard in accordance with this invention.
Figure 5:
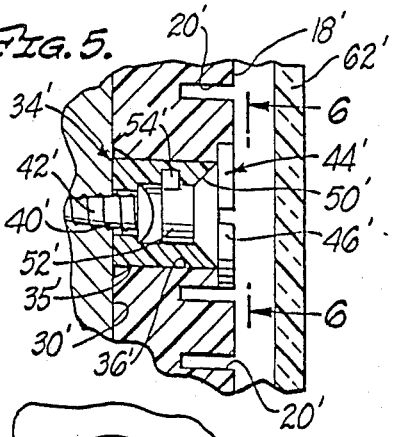
FIG. 5 is a partial cross-sectional view at an enlarged scale taken at line 5—5 of FIG. 4.
Figure 6:
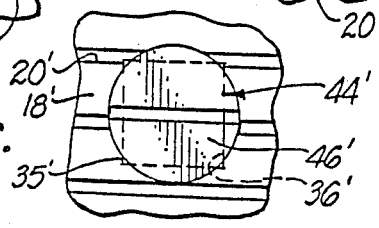
FIG. 6 is a partial cross-sectional view taken at line 6—6 of FIG. 5.

In FIG. 4 of the drawing there is shown a modified signboard 100 which is quite similar to the signboard 10. Because of the close relationships between these two signboards no effort is made to describe those parts of the signboard 100 which are the same or substantially the same as parts of the signboard 10. Such corresponding parts are designated in the drawing and where necessary for explanatory purposes in the remainder of this specification by the primes of the numerals previously used to designate such parts.

The signboard 10' differs from the signboard 10 in that it only uses a single holding means 32' to support the board 12'. In some instances such use of a single holding means 32' will provide adequate support for the sign 100. When such single holding means 32' is used it is considered advisable to form the peripheral wall 35' so that it has a nonround, noncylindrical configuration as shown and to form the opening 36' in a corresponding manner. This construction prevents the sign 100 from rotating on or about the wall 30'.

I claim:

1. In a signboard including a base having a front, a back and a front surface which is adapted to hold replaceable indicia the improvement which comprises:

a holding means for connecting said base with a vertical support for said base, said holding means including a mounting member having a hollow tubular peripheral wall and a bottom which is adapted to be secured to said support through the use of a fastener, said base including an opening located therein which extends between the front and the back of said base and which is shaped so as to fit closely around the exterior of said peripheral wall, said holding means also including a retainer having a head which is adapted to fit against the front of said base and a shank shaped so as to fit within said peripheral wall, said shank and the interior of said peripheral wall being shaped so as to include coacting fastening means which, when engaged, secure said board against movement relative to said holding means.

2. A signboard as claimed in claim 1 wherein;

said signboard includes only one of said holding means, and said peripheral wall has a noncylindrical exterior.

3. A signboard as claimed in claim 2 wherein:

said coacting fastening means are bayonet connecting means.

4. A signboard as claimed in claim 2 wherein:

said head is recessed within said front surface so as not to extend from said front surface and is of the same color as said front surface.

5. A signboard as claimed in claim 1 wherein:

said signboard includes only one of said holding means, and said peripheral wall has a noncylindrical exterior, said coacting fastening means are bayonet connection means, said head is recessed within said front surface so as not to extend from said front surface and is of the same color as said front surface.

6. A signboard as claimed in claim 1 wherein:

said signboard includes three of said holding means, said holding means being spaced from one another.

7. A signboard as claimed in claim 6 wherein:

the peripheral wall on each of said holding means has a cylindrical exterior.

8. A signboard as claimed in claim 6 wherein:

said coacting fastening means are bayonet connection means.

9. A signboard as claimed in claim 6 wherein:

said head is recessed within said front surface so as not to extend from said front surface and is of the same color as said front surface.

10. A signboard as claimed in claim 6 wherein:

the peripheral wall on each of said holding means has a cylindrical exterior, said head is recessed within said front surface so as not to extend from said front surface and is of the same color as said front surface.

11. A signboard as claimed in claim 1 wherein:

said signboard is a rectangular signboard having corners there are four of said holding means, each of said holding means being located adjacent to and associated with one of said corners the peripheral wall of each of said holding means has a cylindrical exterior, said coacting fastening means are bayonet connecting means, said head is recessed within said front surface so as not to extend from said front surface and is of the same color as said front surface.

* * * * *